US005694650A

United States Patent [19]

Hong

[11] Patent Number: 5,694,650

[45] Date of Patent: Dec. 9, 1997

[54] HEATED DOUBLE LENS FACE SHIELD WITH PASSIVE DEFOGGING

[75] Inventor: Scott S. Hong, Cerritos, Calif.

[73] Assignee: Hong Jin Crown America, Inc., Cerritos, Calif.

[21] Appl. No.: 421,369

[22] Filed: Apr. 13, 1995

[51] Int. Cl.[6] ..... A42B 1/08

[52] U.S. Cl. ..... 2/424; 2/15; 2/435; 219/211

[58] Field of Search ..... 2/424, 434, 435, 2/10, 9, 410, 422, 425, 171.3, 15; 219/203, 211, 543, 147

[56] References Cited

U.S. PATENT DOCUMENTS

| | | |
|---|---|---|
| 3,024,341 | 3/1962 | Ogle, Jr. . |
| 4,354,285 | 10/1982 | Rudd . |
| 4,498,202 | 2/1985 | Yamamoto . |
| 4,584,721 | 4/1986 | Yamamoto . |
| 4,612,675 | 9/1986 | Broersma . |
| 4,638,728 | 1/1987 | Elenewski . |
| 4,668,270 | 5/1987 | Ramus . |
| 4,682,007 | 7/1987 | Hollander . |
| 4,698,856 | 10/1987 | Arai . |
| 4,704,746 | 11/1987 | Nava . |
| 4,868,929 | 9/1989 | Curcio . |
| 5,058,212 | 10/1991 | Kamata . |
| 5,086,520 | 2/1992 | Arai . |
| 5,093,937 | 3/1992 | Kamata . |
| 5,093,938 | 3/1992 | Kamata . |
| 5,170,510 | 12/1992 | Nava . |
| 5,170,511 | 12/1992 | Kamata . |
| 5,212,843 | 5/1993 | Kamata . |
| 5,351,339 | 10/1994 | Reuber et al. . |
| 5,394,566 | 3/1995 | Hong . |

FOREIGN PATENT DOCUMENTS

| | | |
|---|---|---|
| 1201149 | 2/1986 | Canada . |
| 1285976 | 7/1991 | Canada . |
| 2090805 | 9/1994 | Canada . |
| 0135812 | 8/1984 | European Pat. Off. . |
| 2091527A | 7/1982 | United Kingdom . |

*Primary Examiner*—Michael A. Neas
*Attorney, Agent, or Firm*—Pons, Smith, Lande & Rose

[57] ABSTRACT

A face shield assembly for a snowmobile or motorcycle helmet has a ventilation system for cold-weather face shield defogging. The face shield has a face shield frame, lower and upper face shield frame vents, and lower and upper air guides to direct the flow of air flowing through the lower and upper vents. The face shield may be a heated double lens shield having a weather lens, a face lens and an air gap in between the weather lens and the face lens. The assembly may also include an electric face shield defogging system having first and second electrodes extending along the upper and lower edge portions, respectively, of the air gap-facing surface of the face lens. Side areas of the face shield are substantially free of visual obstruction so as to enhance the rider's field of vision. There is a separate electric connector at an end of each electrode, with each connector extending through at least one lens and coming into direct contact with its respective electrode. First and second power leads connect with first and second connectors, respectively. The present face shield assembly may be provided without an electric heating system, in which the guided air flow alone acts to defog the shield.

18 Claims, 3 Drawing Sheets

HEATED DOUBLE LENS FACE SHIELD WITH PASSIVE DEFOGGING

BACKGROUND OF THE INVENTION

1. Field of the Invention

The present invention relates to cold weather face shields for snowmobile and motorcycle helmets, and more specifically, to a double lens, heated electric face shield having one or more interior air guides to create an air flow to defog the interior surface of the face lens.

2. Related Art

Snowmobile and motorcycle riders typically wear a protective helmet having a face shield with a generally transparent lens to protect their face from wind, bugs and debris. In very cold weather, the face shield lens is typically rather cold relative to the temperature of the moisture in the rider's breath. Consequently, when the rider exhales, the moisture comes into contact with the cold face lens and condenses. The lens becomes fogged and the rider's vision is obscured. Rider safety can be reduced significantly, and the likelihood of accidents increases.

Various attempts have been made to overcome the problem of face shield fogging. U.S. Pat. No. 4,584,721 to Yamamoto discloses a motorcycle helmet with a heat generating assembly attached to the inner surface of the face shield panel. The heat generating assembly includes a support plate and a heat generating plate, with first and second lead foil conductors and first and second electrodes disposed between the support plate and the heat generating plate. An electrically conductive film extends between the first and second electrodes. Power lead wires connect with first and second lead wire foil conductors, respectively, which in turn connect to the first and second electrodes. When the lead wires are in communication with the power source, an electric current flows from the first electrode to the second electrode through the electro conductive film. The electro conductive film is resistive, and heat is generated from the current flow therethrough. Moisture from the rider's breath is then less likely to condense on the now heated heat generating plate.

There are a number of practical difficulties with the invention of the Yamamoto patent. First, the heat generating unit is not coextensive with the lens of the face shield. Indeed, the heat generating assembly occupies but a small band in the center of the lens. Moisture will condense on the cold portions of the face shield where the heat generating unit is not disposed. Accordingly, a portion of the face shield remains subject to fogging.

Secondly, one of the electrodes of the Yamamoto device extends through the middle of the face shield, in between the upper and lower edges thereof. Since the electrodes and associated lead foil conductors are opaque, the Yamamoto device interferes with the rider's field of vision in the most important area of the face shield. Rider safety is thereby compromised.

Other problems are apparent, such as the high cost of manufacture and the inconvenience of having to install the heat generating unit on an existing face shield. Furthermore, the Yamamoto devices does not provide any means for defogging the face shield when the heating unit is turned off, such as in warmer weather where additional heating of the interior of the helmet is not desired.

U.S. Pat. No. 5,351,339 to Reuber et al. discloses a face shield for a helmet having a weather lens, an inner layer spaced from the weather lens and the backing layer spaced from the inner layer. A first electrode extends along the margin of the inner layer on the surface facing the weather lens. A second electrode extends along a margin of the same surface of the inner layer. A separate printed conductor extends between the inner layer and the backing layer generally along the first electrode past a second end of the first electrode and toward an end of the second electrode. A transparent conductive film extends between the first and second electrodes for generating heat when an electric potential exists between the first and second electrodes.

There are a number of drawbacks to the Reuber et al. face shield. First, the shield is expensive to manufacture because at least two separate printings of electrically conductive ink are required. The electrodes are printed on one side of the inner layer, while the conductor must be printed either on the other side of the inner layer or on the facing side of the backing layer. Secondly, the upper electrode extends along the upper margin of the face lens, then curves around on both ends and follows down the sides of the face lens. Consequently, the rider's vision is disturbed on both sides of the face lens, and peripheral vision is therefore curtailed.

Additionally, the Reuber device does not provide means for defogging the face shield when the electric power is not turned on. Thus, a rider must heat the lens to enjoy the benefits of defogging, even in warmer weather where additional heat is not desired on the interior of the helmet.

SUMMARY OF THE INVENTION

Broadly considered, a double lens face shield assembly for snowmobile and motorcycle helmets has ventilation for cold-weather face shield defogging. The assembly has a face shield frame, a lower face shield frame vent located on a lower portion of the face shield frame and a heated double-lens face shield carried by the face shield frame. A lower air guide is disposed adjacent to the lower face shield frame vent on the interior side of said face shield frame. The air guide extends substantially upwardly along a portion of the double-lens face shield. The air guide directs air that has entered the lower vent to flow substantially upwardly along the double-lens face shield. The user may selectively activate or deactivate heating of the face shield.

The present invention is helpful in overcoming the shortcomings of the prior art in a number of ways. The lower air guide forces air to flow upwardly along the interior surface of the face lens, thereby defogging the lens and preventing cold air from hitting the rider directly in the face. The user may activate the heating of the face shield in cold weather, but may choose not to activate the heating in somewhat warmer weather, in which the air flow along the face lens may be sufficient for defogging purposes. The user may also choose to close the lower vent when no air flow is desired along the face lens.

Considering one embodiment of the present invention in more detail, the assembly may have a deflecting member that is integral to the upper face shield frame for directing air that has entered the upper vent to flow about the exterior of a helmet. The assembly may have an upper face shield frame vent located on an upper portion of the face shield frame and an upper air guide disposed adjacent to the upper air vent. The upper air guide directs air that has entered the upper vent to flow substantially upwardly along a portion of said frame, thereby creating a vacuum that draws air that has entered the lower vent upwardly along said double-lens face shield.

The face shield assembly may further comprise a first electrode, a second electrode and an electroconductive coating extending from said first electrode to said second electrode. The first and second electrodes are in communication with a power source.

The face shield may have a weather lens and a face lens mounted in the frame in a spaced relationship so as to form an air gap therebetween. The face lens may have a face surface, an air gap surface, an upper peripheral portion, a lower peripheral portion and a first and a second side peripheral portion. The first electrode may extend along the upper peripheral portion of the air gap surface of the face lens. The second electrode may extend along the lower peripheral portion of the air gap surface of the face lens, with the first and second side peripheral portions being substantially free of visual obstruction.

The assembly may have first and second connectors, with the first connector being in direct contact with the first electrode and the second connector being in direct contact with the second electrode. First and second power leads may connect to first and second connectors, respectively. Additionally, the first and/or second electrodes may have a main portion and an end portion, with the end portion being separated from the main portion by a space.

One embodiment of the present invention may have upper and lower vents and air guides, without any capacity for heating. That is, the assembly would not include upper and lower electrodes and the associated power leads and power source. This non-electric embodiment provides the advantage of a guided defogging air flow for enhanced defogging relative to other non-electric face shield assemblies.

Other objects, features, and advantages of he invention will become apparent from a consideration of the following detailed description and the accompanying drawings.

DETAILED DESCRIPTION OF THE PREFERRED EMBODIMENTS

Figure 1:
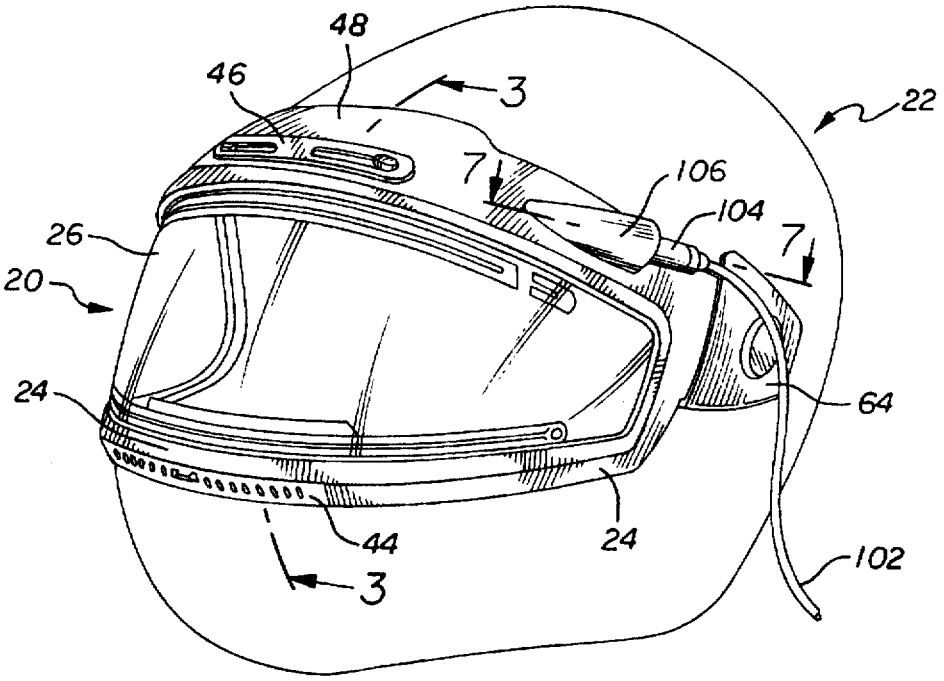
FIG. 1 is a perspective view of a snowmobile helmet with a double lens, heated electric face shield mounted thereon.
Figure 3:
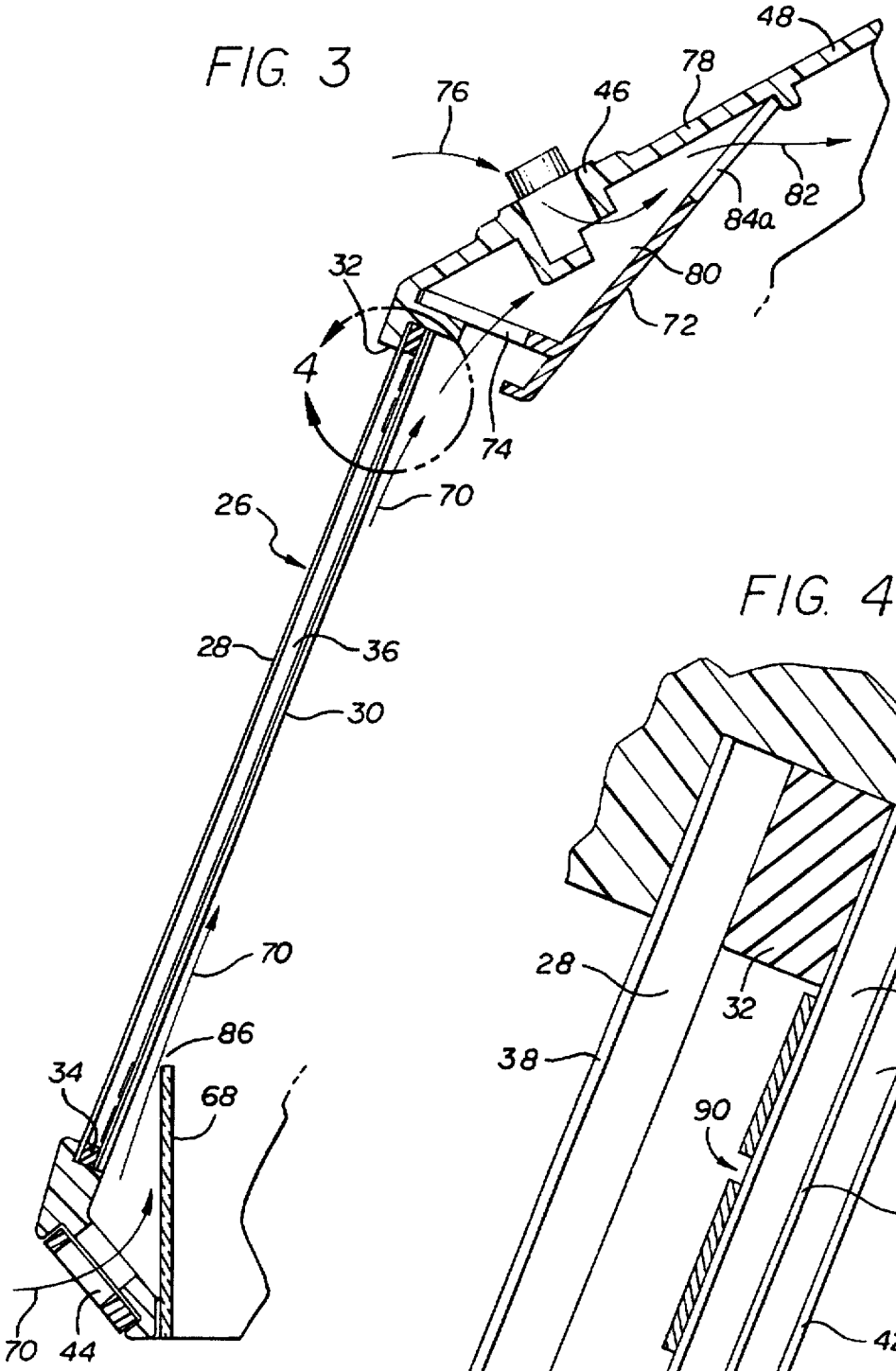
FIG. 3 is a sectional view taken along line 3—3 of FIG. 1.
Figure 4:
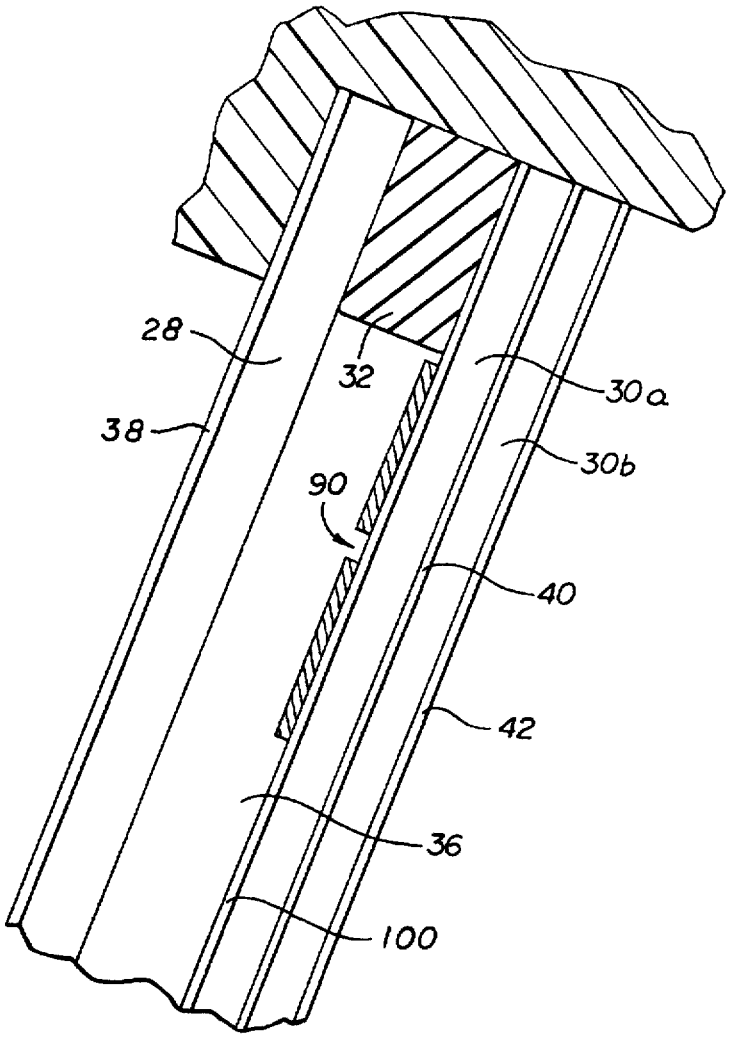
FIG. 4 is a detail view taken in area 4 of FIG. 3.

FIG. 1 illustrates a heated, double-lens face shield 20 mounted on a snowmobile helmet 22. The face shield 20 has a plastic frame 24 and a lens assembly 26 mounted within the central aperture of plastic frame 24. As seen in FIG. 3, lens 26 is of the double lens variety having an exterior weather lens 28 and an interior face lens 30. Spacers 32, 34 separate weather lens 28 and face lens 30 so as to form an air gap 36. Referring to FIG. 4, weather lens 28 has a hard, scratch-resistant coating 38 thereon. Face lens 30 may be made of two layers 30A and 30B, respectively, with a layer of clear adhesive 40 binding thin layers 30A and 30B together. A fog-resistant coating 42 coats the face side of the face lens 30.

Returning to FIG. 1, frame 24 includes a lower air vent 44 on a lower portion of frame 24. An upper vent 46 is located on an upper portion of frame 24. A generally upwardly-projecting air deflector portion 48 is located immediately above upper vent 46.

Figure 2:
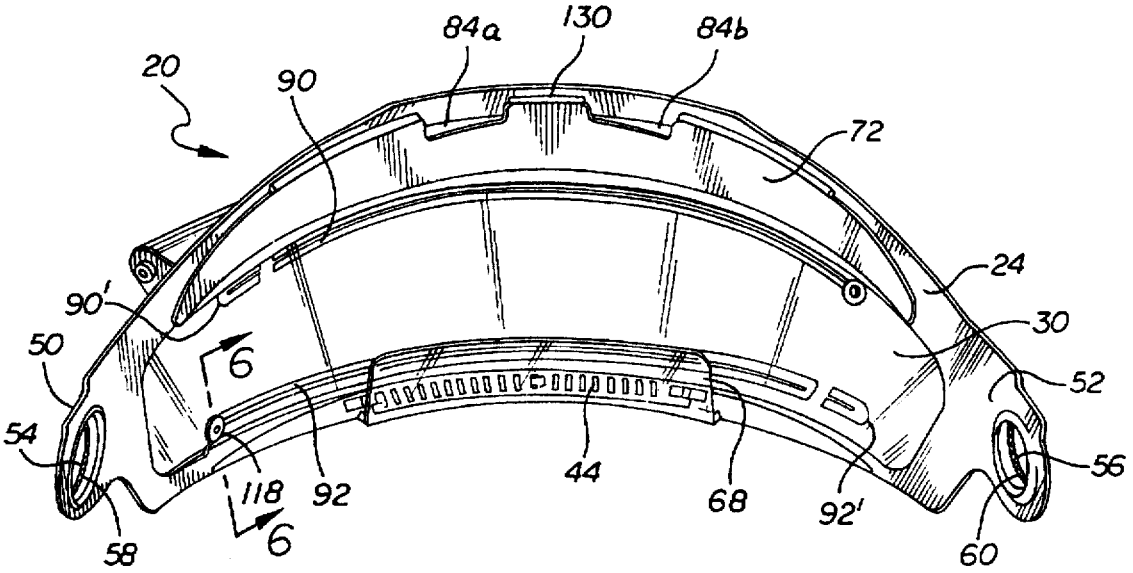
FIG. 2 is a rear perspective view of the heated face shield of FIG. 1.

Referring now to FIG. 2, frame 24 includes ear portions 50, 52, each having an aperture 54, 56, surrounded by teeth 58, 60. These ear portions 50, 52, along with apertures 54, 56, and ring teeth 58, 60, are for mounting the face shield 20 onto a helmet 22 (FIG. 1). In FIG. 1, ear portions 50, 52 are covered by cover plates 64, 66 (not shown).

Returning to FIG. 2, face shield 20 includes a lower air guide 68 mounted on the interior side of frame 24, immediately adjacent to the interior openings of lower air vent 44. Lower air guide 68 extends upwardly above the openings of lower air vent 44, generally at an angle toward face lens 30 (FIG. 3). Lower air guide 68 extends the entire width of lower air vent 44, functioning to direct air entering at the interior side of lower vent 44 upwardly along the face side of inner lens 30.

FIG. 3 illustrates air 70 flowing into lower vent 44. Lower air guide 68 forces air 70 to flow upwardly along the surface of face lens 30, thereby carrying away moisture and defogging the face surface of face lens 30 in cold weather. Returning to FIG. 2, an upper air guide 72 is mounted on the interior side of face shield frame 24, immediately behind the openings of air vent 46. Referring to FIG. 3, air 70 that flows along the face surface of face lens 30 flows into a lower opening 74 in upper air guide 72. Air 76 enters an opening of air vent 46 and enters into the region bounded by upper air guide 72 and upper frame portion 78. It is in this region 80 that air 70 mixes with air 76, with the resulting air flow 82 exiting at upper air guide exit apertures **84*a* and 84*b* (84*a* and 84*b* are both shown in FIG. 2). Upper frame member 48 serves to direct the air flow 84 up and over the top of helmet 22**.

It should be noted that the flow of air 76 through upper vent 46 and up and over helmet 22 creates a vacuum that serves to draw air 70 up along the face surface of face lens 30, thereby increasing the flow of air along face lens 30, resulting in enhanced defogging. By directing the flow of air in the upper portion of the interior side of face shield 20, upper air guide 72 enhances the vacuum effect and therefore results in a cold weather face shield assembly having enhanced defogging capability.

Considering once again lower air guide 68, the orientation of this component results in a relatively narrow space 86 for air 70 to flow through on its journey up and along the face surface of face lens 30. Lower air guide 68 serves at least two important functions. First, lower air guide 68 causes air 70 to flow in a path that maximize defogging. By flowing along the surface of face lens 30, air 70 carries moisture from the rider's breath upwardly and away from the cold surface of face lens 30, where the moisture would otherwise condense and obscure the rider's vision. Secondly, lower air guide 68 prevents cold air 70 from flowing onto the rider's face. In particularly cold weather, the rider's skin is susceptible to frostbite or other discomfort that can occur from being subject to a steady stream of very cold air. Furthermore, the interior temperature of helmet 22 could be significantly reduced below the normal comfort level if air 70 were allowed to circulate within the helmet. Lower air guide 68 prevents such circulation and protects the rider's skin from the stream of very cold air 70.

As discussed above, upper air guide 72 contributes to the functions of the lower air guide 68 by creating a vacuum that ensures that air 70 will flow upwardly along face lens 30 and not onto the rider's face or into the interior of the helmet. It should also be noted that the air space 36 between face lens 30 and weather lens 28 serves as insulation to dampen the effect of very cold weather on face lens 30.

The combination of a double lens face shield having upper and lower vents and upper and lower air guides to create an air flow pattern upwardly along the face surface of the face lens, while preventing flow of very cold air onto the rider's face or throughout the helmet, is in itself an effective means for preventing face lens fogging in normal weather conditions. However, in very cold weather conditions, it is desirable to provide electric heating means to prevent face lens 30 from becoming too cold. Consequently, upper and lower electrodes 90, 92 (FIG. 2) are provided on the air space surface of face lens 30. Each electrode 90, 92 is made of an electrically-conductive, silkscreened ink. Upper electrode 90 follows generally along the upper aperture peripheral edge of frame 24. Lower electrode 92 follows generally along the lower aperture peripheral edge of frame 24.

Referring to FIG. 4, the air space surface of face lens 30 is coated with an electrically-conductive, transparent film 100. Electrodes 90, 92 are disposed directly on top of electrically-conductive film 100. Consequently, when an electrical potential difference is created between upper electrode 90 and lower electrode 92, electric current will flow between the two electrodes through the electrically-conductive film 100. The resistance of the electrically-conductive film 100 causes the current flow to generate heat, thereby heating face lens 30. The heat generated reduces the likelihood of fogging on face lens 30 by reducing the temperature difference between the moisture in the rider's breath and the temperature of face lens 30.

Figure 5:
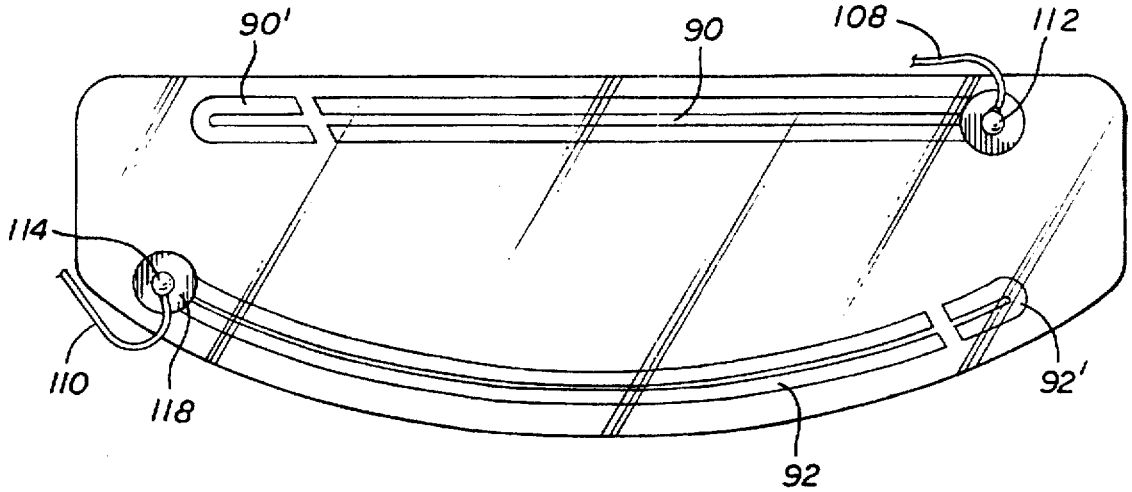
FIG. 5 is a rear view of the lens portion of the heated face shield of FIG. 1.

Referring back to FIG. 1, power is supplied to electric face shield assembly 20 through power cord 102, which has a male plug 104 at one end thereof. Face shield frame 24 includes a female coaxial plug 106 into which male plug 104 is inserted. Referring now to FIG. 5, power leads 108 and 110 extend from coaxial plug 106 to electrically-conductive rivets 112, 114, respectively.

Figure 6:
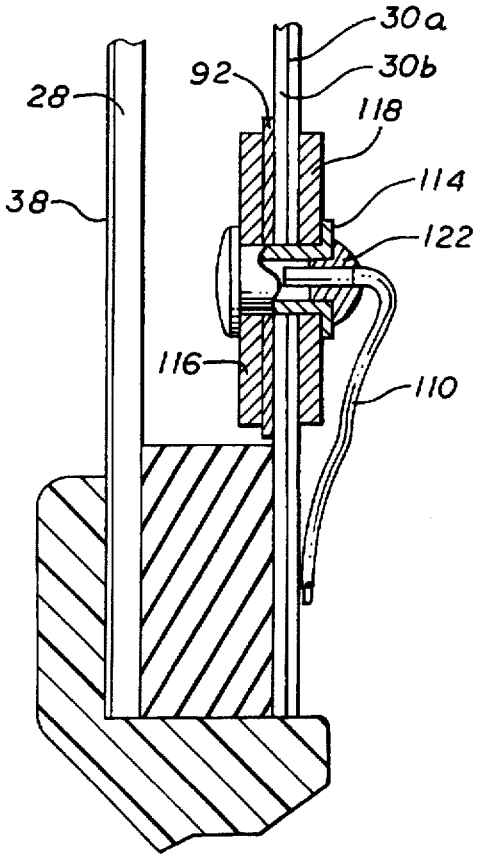
FIG. 6 is a sectional view taken along line 6—6 of FIG. 2.

FIG. 6, which is a sectional view taken along line 6—6 of FIG. 2, shows that rivet 114 extends through the face layer 30A of face lens 30, and continues through air space layer 30B and through lower electrode 92 (not shown). Rivet 114 includes an electrically-conductive air space washer 116 and an electrically-conductive face-side washer 118. Washers 116, 118 are located at one end of lower electrode 92 (see FIG. 2). Returning to FIG. 6, washer 116 is disposed against printed electrode 92 on air space layer 30*a* of face lens 30. Washer 118 is disposed against face layer 30*b* of face lens 30. Power lead 110 is soldered to rivet 114 at solder point 122. A similar arrangement exists with respect to rivet 112.

As discussed above, by hooking energized power cord 102 into coaxial plug 106, an electrical potential difference arises between upper electrode 90 and lower electrode 92. Current then flows along electrically-conductive film 100 in between the electrodes, thereby heating face lens 30 and preventing defogging.

Figure 7:
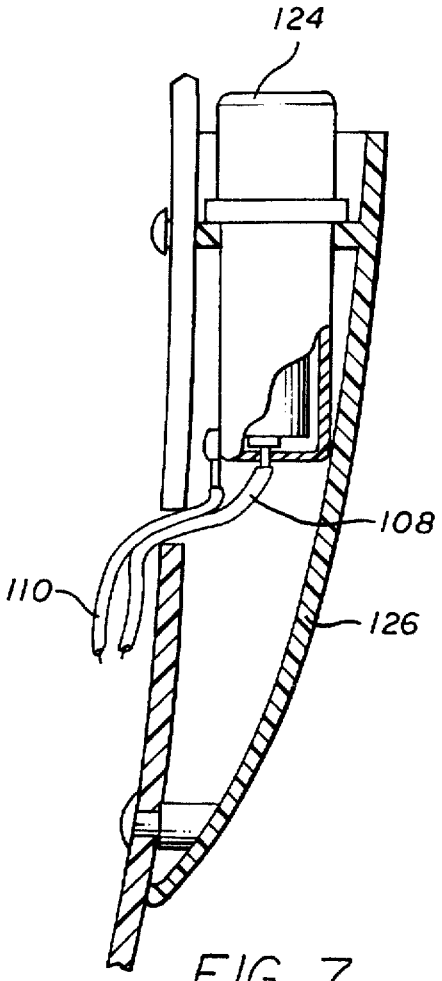
FIG. 7 is a sectional view taken along line 7—7 of FIG. 1.

FIG. 7 illustrates power leads 108, 110 extending from coaxial plug 106. A female plug unit 124 sits within an outer housing 126. Power leads 108, 110 connect to female plug unit 124 and extend therefrom.

Referring again to FIG. 2, it may be noted that lower electrode 92 includes a smaller subportion 92' that is separated by a gap from the main body of electrode 92. Similarly, upper electrode 90 includes a small end portion 90' that is also separated from the main body of electrode 90 by a gap. The purpose for having these small end portions 90', 92', which are separated from the main body of the electrodes 90, 92, has to do with the spacing of upper electrode 90 from lower electrode 92. The distance between the upper and lower electrodes is somewhat less at either end of the electrodes than it is at the mid-region 130 of the shield. If upper and lower electrodes 90, 92 were fully continuous, there would tend to be a relatively strong flow of current across the conductive film between the ends of the electrodes relative to the flow of current at the center portion 130 of the shield. By separating segments 90', 92' from the main body of their respective electrodes, the potential difference between the electrodes at the ends thereof is reduced relative to the potential difference between the main bodies of the respective electrodes. Consequently, the flow of current through the conductive film 100 at the very ends of electrodes 90, 92 is reduced. This reduces or eliminates "hot spot" regions that would otherwise exist at these ends, and heating is fairly uniform within the region bounded by the upper and lower electrodes.

In relatively warm weather, the rider may not need to utilize the electric heating feature of face shield 20 in order to defog face lens 30. The air flow pattern illustrated by FIG. 3 and which the combination of lower and upper vents 44, 46 and lower and upper air guides 68, 72 creates, may be sufficient to prevent fogging of face layer 30 during normal use of the helmet. Indeed, it may be undesirable to energize the electric face shield at relatively warm ambient temperatures because of the collateral heating effect on the interior temperature of the helmet that energizing the electrodes may have. However, in much colder weather, it may be essential for the rider to utilize the electric defogging feature of the face shield. Accordingly, one advantage of electric face shield assembly 20 is its adaptability to different ambient temperature conditions. In warm weather, the rider may rely on the passive ventilation defogging system to prevent fogging of the face lens 30. In warmer weather, the user may rely on a combination of the passive defogging air flow and the defogging effect of the electrical system.

Electric, double lens face shield 20 may be constructed of the following materials. Face shield frame 24 may be made of polycarbonate, or, alternatively, from ABS. Face lens 30 may be a two-ply sheet of PET material, with the two layers of PET laminated together with a thin adhesive layer. For purposes of illustration, and not limitation, the META CRYSTAL T-40 sheet material, which is produced by Toyo Metallizing Company of Tokyo, Japan, may be used for face lens 30. Weather lens 28 is typically made of polycarbonate, while spacers 32, 34 are typically neoprene. Anti-fog layer 42 may be vinyl acetate and ethylene.

The electrodes 90, 92 are typically made of a silkscreened, electrically-conductive ink. The ink maybe an epoxy resin mixed with silver, which has very good conductivity and little resistance. The conductive coating 100 is may be a thin layer of Indium Tin Oxide, which is applied by a sputtering method. The conductive coating 100 may alternatively be applied by a vacuum deposition method or an electronic beam heating deposition method. This thin Indium Tin Oxide conductive coating typically transmits 70% or more of the light, and can generally be said to be substantially transparent.

Upper air guide 72 may be made of polycarbonate or, alternatively, ABS, and is ultrasonically bonded to the upper interior portion of frame 24. Lower air guide 68 may be a clear polycarbonate and is attached to the lower interior portion of frame 24 by either a 2-sided adhesive tape or, alternatively, with screws, plastic pins or rivets. The substantially clear material of the lower air guide prevents the obstruction of vision that would occur if the lower air guide were to be made of an opaque material.

Rivets 112, 114 and their associated washers are typically made of copper and are coated with silver to improve conductivity. Power leads 108, 110 are typically a 26-gauge copper wire. Power cord 102 typically connects to a 12-volt DC or AC power source, such as a battery, and typically carries 0.85–1.3 amps.

Considering electrodes 90, 92 in more detail, it is noted that each electrode 90, 92 has both an upper and a lower portion separated by a central space. Not counting the central space, the width of the silkscreened ink portion of the upper and lower electrodes 90, 92 should be at least 6 mm wide in the presently preferred embodiment in order to ensure that the electrodes can carry the current of a 12-volt, 0.85–1.3 amp power source. The thickness of electrodes 90, 92 is often determined by manufacturing limitations, and the manufacturer can normally only make the electrodes wider rather than thicker.

As far as the purpose of having two separate portions to each electrode relates to the adherence of the electrode to the air space surface of face lens 30, it has been determined that the silkscreened, electrically-conductive ink tends to adhere most strongly at the edges of the ink pattern. By separating the electrodes into upper and lower portions with a narrow air space in between, each electrode has four edges adhering to face lens 30, rather than the two edges that would result if each electrode was one solid line. By having an additional two edges, adherence of the electrode to the face lens is significantly improved, and the likelihood of the electrode peeling is thereby reduced.

The following are exemplary dimensions for one embodiment of the present invention. These dimensions are given to illustrate the dimensions of one embodiment and not as limitations. Air deflector 48 may be a fin-like member approximately 1 cm. tall and 10 cm. wide at the upper edge. Electrodes 90, 92 may be spaced approximately 10 cm. from each other at midpoint 130, and approximately 6 cm. from one another at the very ends of the electrodes. The lower air guide 68 may be 13 cm. wide when flattened out, and 3 cm. tall. Openings 74, 75, 82 and 83 in upper air guide 72 may be 2.5 cm. wide.

Electrodes 90, 92 each have a total printed ink width of about 6 mm. with a thickness of between about 0.03 mm. and 0.034 mm. to carry 1 amp. at 12V. That is, each electrode should have a cross-sectional area of at least 0.18 $mm^2$–0.20 $mm^2$ to prevent excessive electrode resistance. It may be noted that the electrodes 90, 92 illustrated in the drawings are each divided into upper and lower parts, each about 3 mm. wide, separated by a 1 mm space. As explained above, dividing each electrode into upper and lower parts facilitates strong bonding of the printed electrodes to the substrate.

In conclusion, it is to be understood that the foregoing detailed description and the accompanying drawings relate to preferred embodiments of the invention. Various changes and modifications may be made without departing from the spirit and scope of the invention. Thus, by way of example and not of limitation, face lens 30 may be one layer rather than two layers adhered together. Power leads 108 and 110 may be molded into frame 24, rather than being separate wires. The power leads 108, 110 may be connected to their associated rivets 112, 114 by means other than soldering. Rivets 112, 114 may be replaced by other types of connectors at the electrodes.

Regarding variations to the upper and lower vents 44, 46, FIG. 1 shows upper vent 46 as having two spaced slots, with a slider in each slot. To fully open the upper vent, the user slides the sliders outwardly. To close or partially close the upper vent, the user slides one or both sliders inwardly toward the center. The bottom vent 44 consists of a series of spaced apertures covered by a sliding member that also has a series of spaced apertures. The user may open bottom vent 44 by sliding the sliding member to align the apertures, and may close the bottom vent by sliding the sliding member such that the apertures are not aligned. These two types of vents are examples only, and other types of vents known in the art may be alternatively employed.

Accordingly, the present invention is not limited to the specific embodiment shown in the drawings and described in the detailed description.

What is claimed is:

1. A double lens, heated face shield for a motor sports helmet comprising:

a shield frame having a lens aperture, a lower air vent, and an upper air vent;

a weather lens mounted within the aperture of said shield frame;

a face lens mounted within the aperture of said shield frame such that there is an air space between said weather lens and said face lens, said face lens having a face side and an air space side;

an upper electrode on said air space side of said face lens;

a lower electrode on said air space side of said face lens;

said face lens having an upper edge portion, a lower edge portion, and right and left end portions, said upper and lower electrodes being only on said upper and lower edge portions of said face lens, respectively;

an electroconductive film on said air space side of said face lens, said film extending between and being in contact with said lower electrode and said upper electrode;

a generally upwardly-extending lower air guide mounted on said frame immediately behind said lower air vent;

an upper air guide mounted on said frame behind said upper vent; and said end portions being substantially transparent and being free of electrodes and other non-transparent objects, so that a user's peripheral vision is not obstructed over both of said end portions;

wherein said lower air guide directs air entering said lower vent upwardly along a surface of said face lens to defog said surface of said face lens and to prevent moisture from condensing on said face lens.

2. A double-lens face shield as defined in claim 1, wherein said face shield further comprises:

a first contact in contact with said upper electrode, said contact extending through at least one of said lenses;

a second contact in contact with said lower electrode, said contact extending through at least one of said lenses;

a first power lead connecting to said first contact; and a second power lead connecting to said second contact.

3. A double-lens face shield as defined in claim 1, wherein said lower air guide extends the entire width of said lower air vent, said lower air guide also extending to a height at least ½" above said air vent.

4. A double-lens face shield as defined in claim 1, wherein said upper air guide extends the entire width of said upper air vent, said upper air guide having a lower portion and an upper portion, said lower portion having at least one opening to receive air flowing up along said face lens, said upper portion having at least one exit opening in communication with said lower portion opening.

5. A double-lens face shield as defined in claim 1, wherein said frame includes a deflecting member that is integral to said upper face shield frame for directing air that has entered the upper vent to flow about the exterior of a helmet when said face shield frame is mounted on the helmet.

6. A double-lens face shield as defined in claim 5, wherein said deflecting member is a substantially fin-like member located immediately above said upper vent.

7. A double-lens face shield as defined in claim 1, wherein said frame includes a power jack thereon, said power leads extending from said power jack.

8. A double-lens face shield as defined in claim 1, wherein said electrodes are substantially an electroconductive ink.

9. A double lens, heated face shield for a motor sports helmet comprising:

a shield frame having a lens aperture, a lower air vent, and an upper air vent;

a lens assembly comprising a weather lens and a face lens, said weather lens and said face lens each mounted within the aperture of said shield frame such that there is an air space between said weather lens and said face lens, said face lens having a face side and an air space side, said face lens being substantially coextensive with said weather lens;

an upper electrode on said air space side of said face lens;

a lower electrode on said air space side of said face lens;

an electroconductive film on said air space side of said face lens, said film extending between and being in contact with said lower electrode and said upper electrode;

a first contact in direct contact with said upper electrode, said contact extending through at least one of said lenses; and a second contact in direct contact with said lower electrode, said contact extending through at least one of said lenses;

wherein said lens assembly has an upper portion, a lower portion and first and second side portions, said upper and lower electrodes extending only within said upper and lower portions, respectively, said first and second side portions substantially permitting light to pass through without obstruction, so that a user may see through said first and second side portions and so that said side portions are both substantially free of visual obstructions that would interfere with the user's peripheral vision.

10. A double lens, heated face shield as defined in claim 9, wherein said face shield further comprises a lower air guide disposed adjacent to and behind said lower vent on the face side of said face shield frame, said lower air guide extending substantially upwardly along a portion of said double-lens face shield and being mounted on said face side of said face shield frame, wherein said lower air guide directs air flowing into said lower vent upwardly along said face side of said face lens.

11. A double lens, heated face shield as defined in claim 10, wherein said face shield further comprises an upper air guide disposed adjacent to said upper vent on the face side of said face shield frame, said upper air guide having at least one lower entrance and at least one upper exit, said upper air guide directing air flowing into said upper vent upwardly along said frame, thereby creating a vacuum that draws air flowing into said lower vent upwardly along said face side of said face lens and into said lower entrance.

12. A double lens, heated face shield as defined in claim 9, wherein said face shield further comprises a power jack disposed on said frame and power leads extending from said power jack directly to said first and second contacts.

13. A double lens, heated face shield as defined in claim 9, wherein said upper and lower air vents each have an open position permitting air to enter, and a closed position obstructing air from entering.

14. A double lens, heated face shield as defined in claim 9, wherein said face shield further comprises an upper air deflector integral to said frame, said air deflector comprising a fin-like member.

15. A double lens face shield assembly for snowmobile and motorcycle helmets, the assembly having ventilation for cold-weather face shield defogging and comprising:

a face shield frame;

lower face shield frame vent located on a lower portion of said face shield frame, said lower face shield frame vent having air flow openings;

a heated double-lens face shield carried by said face shield frame; and a lower air guide disposed adjacent to said lower face shield frame vent on the interior side of said face shield frame behind said lower face shield frame vent and at a spaced distance from said air flow openings, said air guide extending substantially upwardly along a portion of said double-lens face shield;

wherein said face shield further comprises a first electrode, a second electrode, an electroconductive coating extending from said first electrode to said second electrode, said first and second electrodes being in communication with a power source, said face shield having side portions that are substantially transparent and are entirely free from visual obstruction, so that a user may see through said side portions without obstruction to his or her peripheral vision; and wherein said lower air guide directs air that has entered the lower vent to flow substantially upwardly along said double-lens face shield, and wherein the user may selectively activate or deactivate heating of the face shield.

16. A double lens face shield assembly for snowmobile and motorcycle helmets as defined in claim 15, wherein:

said face shield comprises a weather lens and a face lens, said weather lens and said face lens being mounted in said frame in a spaced relationship so as to form an air gap therebetween;

said face lens having a face surface, an air gap surface, an upper peripheral portion, a lower peripheral portion and a first and a second side peripheral portion;

said first electrode extending only along said upper peripheral portion of said air gap surface of said face lens without extending into said side peripheral portions;

said second electrode extending only along said lower peripheral portion of said air gap surface of said face lens without extending into said side peripheral portions;

and said first and second side peripheral portions being substantially transparent and being entirely free of visual obstruction.

17. A double lens face shield assembly for snowmobile and motorcycle helmets as defined in claim 15, wherein said assembly further comprises a first connector and a second connector, said first connector being in direct contact with said first electrode and said second connector being in direct electrical contact with said second electrode, said assembly further comprising a first power lead that is connected to said first connector and a second power lead that is connected to said second connector, wherein said assembly is free of any printed ink conductors intermediate between said power lead and said electrodes.

18. A double lens face shield assembly as defined in claim 15, wherein said lower air guide is a thin piece of transparent material that is attached to said frame, wherein said lower air guide forms a barrier that deflects air after it has exited said lower air vent upwardly along said face shield.

* * * * *